United States Patent [19]

Seeberg et al.

[11] 3,975,240

[45] Aug. 17, 1976

[54] PROCESS AND SYSTEM FOR DETERMINING THE END OF A COKING PROCESS

[75] Inventors: Horst Seeberg; Horst Fach, both of Essen, Germany

[73] Assignee: Didier Engineering GmbH, Essen, Germany

[22] Filed: Jan. 7, 1976

[21] Appl. No.: 647,171

[30] Foreign Application Priority Data

Jan. 14, 1975 Germany ..... 2501199

[52] U.S. Cl. ..... 201/1; 73/340; 73/343 R; 202/254

[51] Int. Cl.[2] ..... C10B 47/00; G01K 3/08

[58] Field of Search ..... 201/1; 202/254, 255, 202/256; 73/340, 341, 342, 343 R, 432 R, 15R

[56] References Cited

UNITED STATES PATENTS

| | | | |
|---|---|---|---|
| 3,556,947 | 1/1971 | Kumper | 201/1 |
| 3,607,660 | 9/1971 | Kumper | 201/1 |

*Primary Examiner*—Donald O. Woodiel
*Attorney, Agent, or Firm*—Wenderoth, Lind & Ponack

[57] ABSTRACT

Separate temperature measuring elements are positioned on the outer wall surface of the riser of at least one oven chamber of a coke oven. During production of coke, the temperatures measured will be different. Upon completion of the coking process the difference between the measured temperatures will lessen to zero.

11 Claims, 5 Drawing Figures

PROCESS AND SYSTEM FOR DETERMINING THE END OF A COKING PROCESS

BACKGROUND OF THE INVENTION

The present invention relates to a measuring arrangement or system for determining the end of the coking process for a coke oven, wherein the filling gases formed during the coking process in the oven chambers are removed through risers.

It is well known that the coal filled into oven chambers of coke ovens is coked under the effect of heat. The gases formed in this connection in the oven chambers are led off for the purpose of further processing. After the coking process is completed, the coal is ejected as coke from the oven chambers. Then the oven chambers are ready for a new fill. The course of the coking process is a function of the intensity with which the oven chambers are fired. After the completion of the coking process, the oven may be switched off.

It is of decisive importance to know the time at which the coking process is completed, so that the firing of the oven chambers or the coal subjected to coking is performed for a time which is neither too long nor too short.

SUMMARY OF THE INVENTION

The object of the present invention is to provide a measuring arrangement or system with which it is possible to precisely determine the end of the coking process, and which is of a structure such that the effects thereon of thermal stressing and the corrosive gases are reduced.

The above object is achieved according to the present invention in that temperature measuring members are arranged in at least two spaced positions on at least one coke oven riser. The members measure the surface temperatures of the riser at such positions. The resultant temperature dependent output signals of the temperature measuring members indicate the end of the coking process when the difference in the signal values is lessened or reduced. The present invention is based on the discovery or knowledge that differential temperatures occur at different positions of the riser as long as filling gas is conveyed from the oven chambers, and that toward the end of the coking process the temperatures at such different positions gradually become similar or approach each other until they become equal.

The measuring system or arrangement of the present invention provides considerable advantages. For example, it is no longer necessary to provide for equalization of a temperature measured within the riser with a reference temperature, which is fixed and which is determined to be indicative of the end of the coking process, since according to the invention a measured difference, preferably zero, between temperatures indicates the end of the coking process. Further, the temperature measuring members or elements need not be situated in the interior of the risers. Such location would be disadvantageous in that there are difficulties in attachment of the members, that passage through the riser is obstructed, and also that the temperature measuring members become rapidly corroded and inoperative.

In accordance with the present invention, the temperature measuring members are preferably arranged on the outer side of the riser walls. The temperature measuring elements are thus not positioned in the path of gas flow of the riser pipe, and previously required bushings extending through the riser are unnecessary. The temperature measuring members can easily be serviced or replaced even during the operation of the coke oven without disruption of the operation.

In order to provide a particularly simple means of attachment of the temperature measuring members to the riser, the riser is provided with exterior pockets for receiving the temperature measuring members.

In a preferred embodiment of the invention, the riser possesses a bend and a first temperature measuring member is arranged in the area of one arm of the bend, while a second temperature measuring member is arranged in the area of the other arm of the bend.

BRIEF DESCRIPTION OF THE DRAWINGS

A preferred and exemplified embodiment of the present invention will be explained in detail in the following description, taken with the accompanying drawings, wherein.

DETAILED DESCRIPTION OF THE INVENTION

Figure 1:
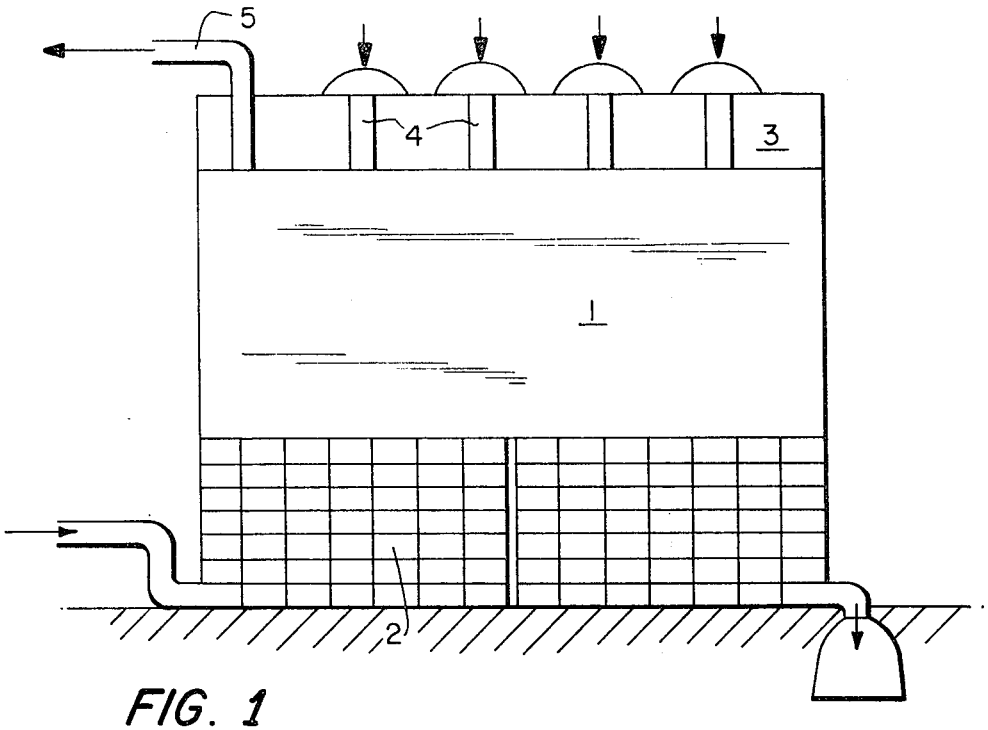
FIG. 1 is a schematic view of a coke oven.

The coke oven shown in FIG. 1 may be any conventional type oven and includes a series of oven chambers 1 (only one chamber being shown) positioned one after another. The heating flues (not shown) for heating the oven chambers are positioned between the chambers. Heat regenerators 2 are ordinarily arranged below the oven chambers and are employed for preheating the heating gas. The oven chambers are covered with a common oven roof which includes a plurality of filling openings 4 associated with each oven chamber.

The filling gases formed in each oven chamber during the coking process are removed from the respective oven chamber through a riser pipe 5. The separate risers of each oven chamber join in a common collecting main 6 (see FIG. 2).

Figure 2:
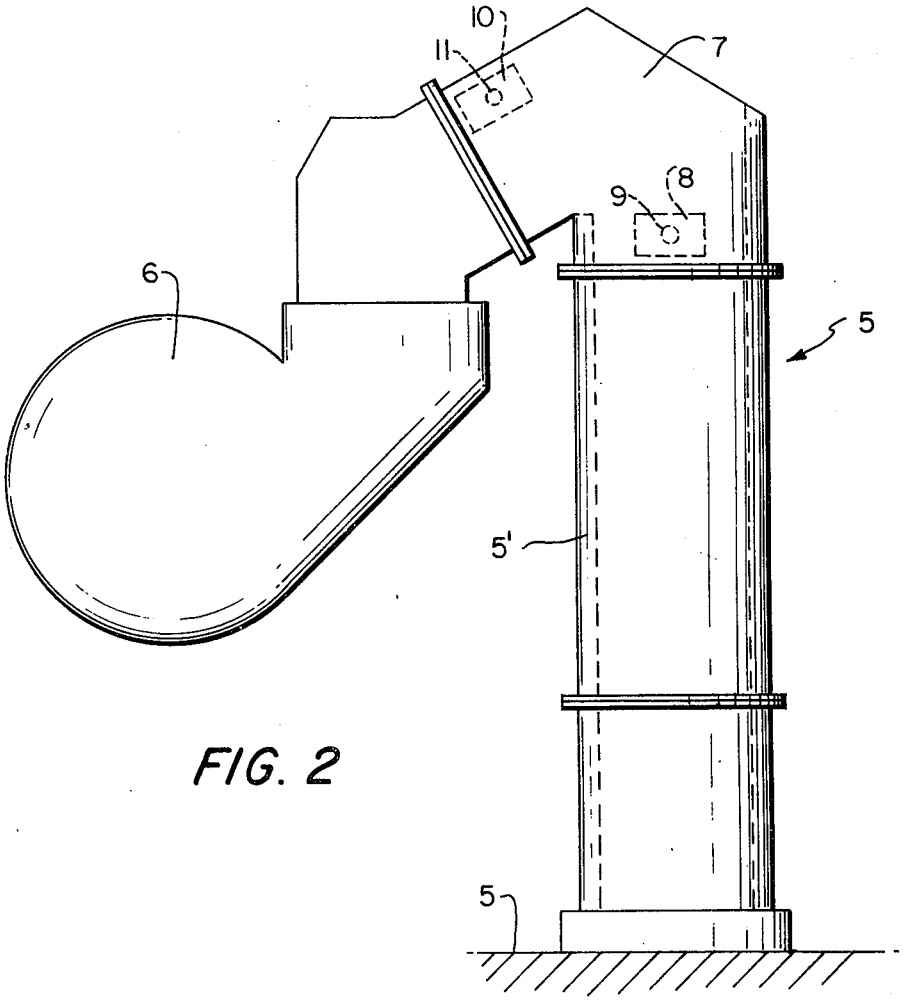
FIG. 2 is a schematic view of a riser pipe of the coke oven on an enlarged scale.

As shown in FIG. 2, the interior of riser 5 may be lined with an insulating material 5′ resistant to high temperatures. In a preferred embodiment, the riser 5, at its upper end, is constructed to have a bend 7. In an area 8 of one arm of the bend, there is arranged a first temperature measuring member 9, and in an area 10 of the other arm of the bend, there is arranged a second temperature measuring member 11. Temperature measuring members 9 and 11 are positioned to measure temperatures of the outer surface of the riser.

Figure 3:
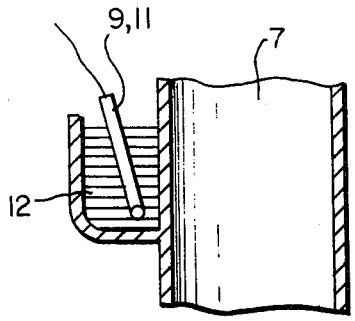
FIGS. 3 and 4 are section views of two alternative embodiments of attachment of temperature measuring elements to the riser wall.
Figure 4:
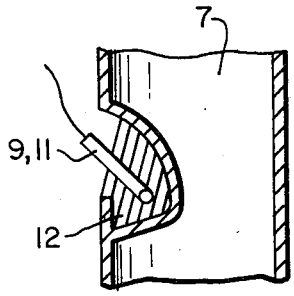

FIGS. 3 and 4 respectively show pockets 12 projecting from and into the riser. Temperature measuring members 9 and 11 can be easily placed and positioned in such pockets to measure the riser wall temperature.

Figure 5:
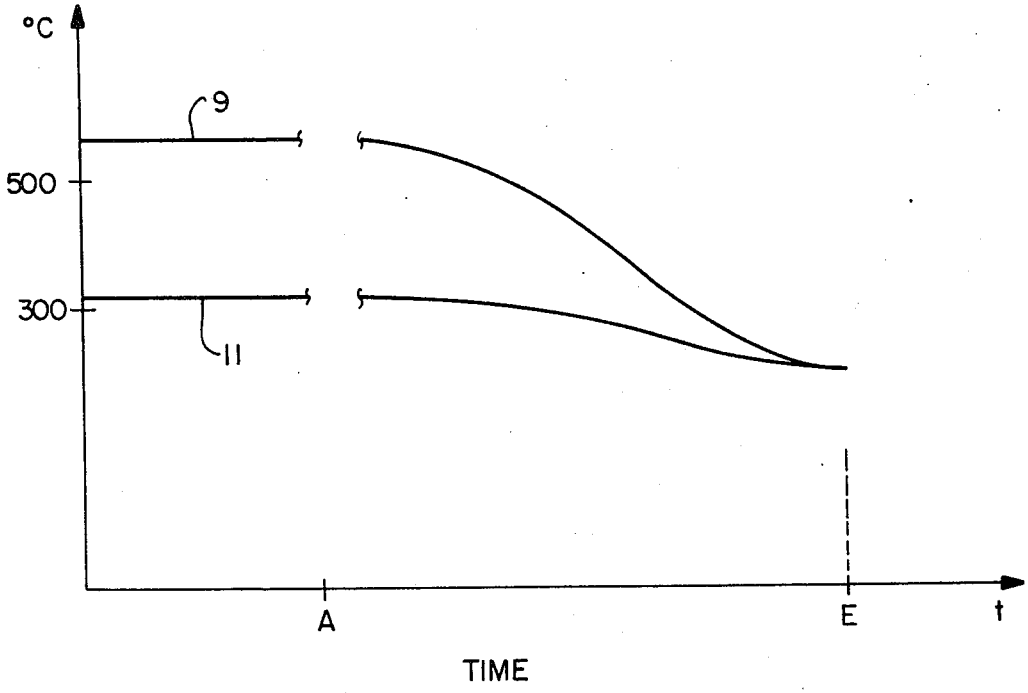
FIG. 5 is a temperature diagram illustrating the principle of the invention.

FIG. 5 illustrates temperature curves of temperatures measured by measuring members 9 and 11 during the coking process, as plotted against time, and illustrates the principle of the invention. It can be seen that during the majority of the time period of the coking process, i.e. up to point A in FIG. 5, the difference between the temperature measured by temperature measuring member 9 and the temperature measured by temperature measuring member 11 is substantially unchanged.

Toward the end of the coking process, the values of the two measured temperatures gradually approach each other. When the two temperatures are the ssame, at a point E of FIG. 5, the coking process is completed. The determination that temperature difference between the temperatures measured by measuring member 9 and measuring member 11 equals zero can be used to automatically or manually switch off the firing of the oven and eject the coke from the oven chambers.

The exact positions of temperature measuring members 9 and 11, and of additional temperature measuring members if desired, on the exterior of riser 5 is not of critical importance. The important feature is that the temperature measuring members be placed at positions whereat the surface temperature of the riser is different during a coke production operation.

The temperature measuring elements are preferably provided not only on the riser of a single oven chamber, but rather on all the risers or on the risers associated with a plurality of the oven chambers. The end of the overall coking process can then be determined by forming a mean value of the temperature differences measured at the various risers.

It will be apparent that various modifications may be made to the above specifically described structural arrangement without departing from the scope of the invention.

What is claimed is:

1. A system for determining the end of a coking process in a coke oven of the type wherein fill gases formed during the coking process are removed from oven chambers of the coke oven through risers, said system comprising:

separate temperature measuring means, positioned on the riser of at least one oven chamber at locations thereon whereat the temperatures are different during the production of coke but whereat said temperatures are equal at the completion of the coking process, for detecting said temperatures and generating signals representative thereof and for providing an indication of the completion of the coking process when the difference between said signals lessens.

2. A system as claimed in claim 1, wherein said temperature measuring means are positioned on the outer wall surface of said riser.

3. A system as claimed in claim 2, wherein said temperature measuring means are positioned in pockets on said riser.

4. A system as claimed in claim 3, wherein said pockets project from said riser.

5. A system as claimed in claim 3, wherein said pockets project into said riser.

6. A system as claimed in claim 1, wherein said riser has a bend therein, a first of said temperature measuring means being positioned on a first arm of said bend, and a second of said temperature measuring means being positioned on a second arm of said bend.

7. A system as claimed in claim 1, wherein said temperature measuring means are positioned on the risers of all of said oven chambers.

8. A process for determining the end of a coking process in a coke oven of the type wherein fill gases formed during the coking process are removed from oven chambers of the coke oven through risers, said process comprising:

measuring the temperatures of the riser of at least one oven chamber at spaced locations thereon whereat such temperatures are different during the production of coke but whereat said temperatures are equal at the completion of the coking process; and detecting when the difference between the measured temperatures lessens.

9. A process as claimed in claim 8, further comprising, upon the detection of a lessening of said temperature difference, terminating operation of said coke oven.

10. A process as claimed in claim 8, wherein said temperatures are measured on the risers of all of said oven chambers.

11. A process as claimed in claim 8, wherein said temperatures are measured on the outer wall surface of said riser.

* * * * *